US005082011A

United States Patent [19]

Wu

[11] Patent Number: 5,082,011

[45] Date of Patent: Jan. 21, 1992

[54] HAIR FASTENING DEVICE

[76] Inventor: Fu-Chi Wu, 17336 Chase St., Northridge, Calif. 91328

[21] Appl. No.: 568,981

[22] Filed: Aug. 17, 1990

[51] Int. Cl.[5] ..... A45D 8/02

[52] U.S. Cl. ..... 132/281; 132/273

[58] Field of Search ..... 132/101, 105, 106, 127, 132/128, 60, 63.1, 65.1, 72.1, 273, 281, 282, 283, 219, 276, 284

[56] References Cited

U.S. PATENT DOCUMENTS

| | | | |
|---|---|---|---|
| 842,524 | 1/1907 | Cartwright | 132/281 |
| 958,339 | 5/1910 | Watson | 132/281 |
| 1,397,904 | 11/1921 | Rhein et al. | 132/281 |
| 1,429,712 | 9/1922 | Busby | 132/281 |
| 1,434,961 | 11/1922 | Noe | 132/281 |
| 1,714,358 | 5/1929 | Finkelstein | 132/105 |
| 1,875,611 | 9/1932 | Jenkins | 132/281 |
| 2,664,883 | 1/1954 | Smith | 132/281 |
| 3,330,287 | 7/1967 | Muhs | 132/281 |

FOREIGN PATENT DOCUMENTS

| | | | |
|---|---|---|---|
| 481613 | 3/1952 | Canada | 132/273 |
| 2303338 | 8/1973 | Fed. Rep. of Germany | 132/219 |
| 599815 | 1/1926 | France | 132/219 |

*Primary Examiner*—John J. Wilson
*Assistant Examiner*—Frank A. LaViola
*Attorney, Agent, or Firm*—Spensley Horn Jubas & Lubitz

[57] ABSTRACT

A toothed hair fastener having leaf-spring elements situated between one or more of the teeth of the fastener, and suitable for both thick and thin hair. Preferably, the leaf-springs are integrally formed as part of the toothed hair fastener.

18 Claims, 2 Drawing Sheets

HAIR FASTENING DEVICE

BACKGROUND OF THE INVENTION

1. Field of the Invention

This invention relates to hair fastening devices, and more particularly to toothed hair fasteners having leaf-spring elements situated between the teeth of the device, and suitable for both thick and thin hair.

2. Related Art

Hair combs and related hair fastening devices, such as chignon pins, have traditionally been made with narrow-spaced teeth or prongs for use with thin hair, and with wide-spaced teeth for use with thick hair. Devices having narrow-spaced teeth are difficult to insert into thick hair, and devices having wide-spaced teeth tend to be easily dislodged when used in thin hair. Therefore, it has been common for merchants to maintain an inventory of both types of devices to accommodate hair of different thicknesses.

Therefore, it would be desirable to provide a single type of hair fastening device that can be used with either thin or thick hair. The present invention provides such a device that can be easily and inexpensively manufactured.

SUMMARY OF THE INVENTION

The invention comprises toothed hair fastening devices having leaf-springs situated between one or more of the teeth of the device. The leaf-springs are preferably integrally formed as part of each toothed hair fastening device.

The details of the preferred embodiment of the present invention are set forth in the accompanying drawings and the description below. Once the details of the invention are known, numerous additional innovations and changes will become obvious to one skilled in the art.

BRIEF DESCRIPTION OF THE DRAWINGS

Like reference numbers and designations in the drawings refer to like elements.

DETAILED DESCRIPTION OF THE INVENTION

Throughout this description, the preferred embodiment and examples shown should be considered as exemplars, rather than limitations on the structure of the present invention.

Figure 1:
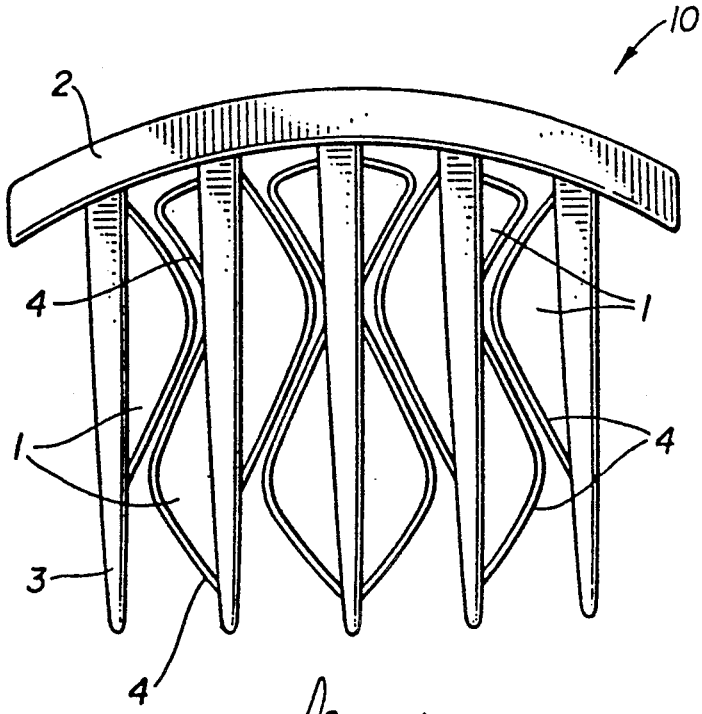
FIG. 1 is a front view of a curved-back hair comb embodying the present invention.

FIG. 1 shows a front view of a curved-back hair comb 10 embodying the present invention. The comb 10 includes a curved spine 2 having a number of projecting teeth 3. As in known in the art, the comb teeth 3 can be integrally formed with the back 2 of the comb 10, or separately manufactured and affixed thereto. The teeth 3 are generally, but not necessarily, parallel. Further, the teeth 3 may be straight, or curved (e.g., wavy) in any dimension.

Affixed at intervals to one or more of the teeth 3 are leaf-springs 4 formed of a resilient material, such as a flexible plastic. Each leaf-spring 4 is attached to its associated tooth 3 so as to leave open space 1 between the leaf-spring 4 and the tooth 3. As shown in FIG. 1, leaf-springs 4 from adjacent teeth 3 are preferably designed to approximately conform to each other's shape. Such conformance leaves little or no gap between adjacent leaf-springs 4.

In the preferred embodiment of the invention, the leaf-springs 4 are integrally injection molded as part of the teeth 3 using a suitable flexible elastic material such as for example polypropylene, polyethylene, nylon or acetate celloluse. However, if desired, the leaf-springs 4 can be separately manufactured, and affixed to the teeth 3 in any desired fashion (for example, by heat welding, gluing, or ultrasonic bonding).

The purpose of the larger teeth 3 is to "split" relatively large groups of hair strands apart. Because the teeth 3 of the present invention are relatively widely spaced (comparable to the widely spaced teeth used for combs designed for thick hair), hair fastening devices designed in accordance with the present invention can be inserted into thick hair relatively easily.

As the teeth 3 of a comb 10 penetrate into a user's hair, each group of strands of the user's hair slides in between the leaf-springs 4, which are flexibly displaced during such insertion. The restorative spring force of adjacent leaf-springs 4 exerts a clamping force against the hair, and thus the leaf-springs 4 firmly clasp even thin hair.

Therefore, the stronger, more widely spaced teeth 3 of the comb 10 are used to initially penetrate hair, while the leaf-springs 4 are used to clamp the comb 10 to the hair and maintain the comb 10 in position after insertion.

Figure 2:
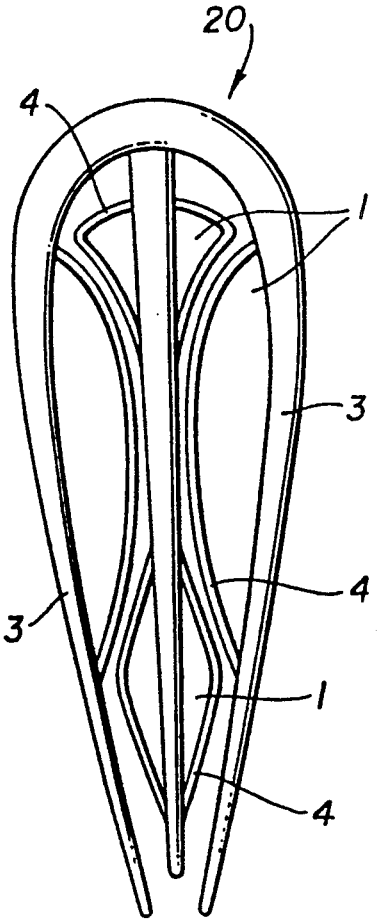
FIG. 2 is a front view of a hair fastening pin embodying the present invention.

FIG. 2 is an alternative comb or pin-like device 20 showing an alternative configuration of the teeth 3 and leaf-springs 4. The principle of operation of this device 20 is the same as the curved-back comb 10 in FIG. 1.

Figure 3:
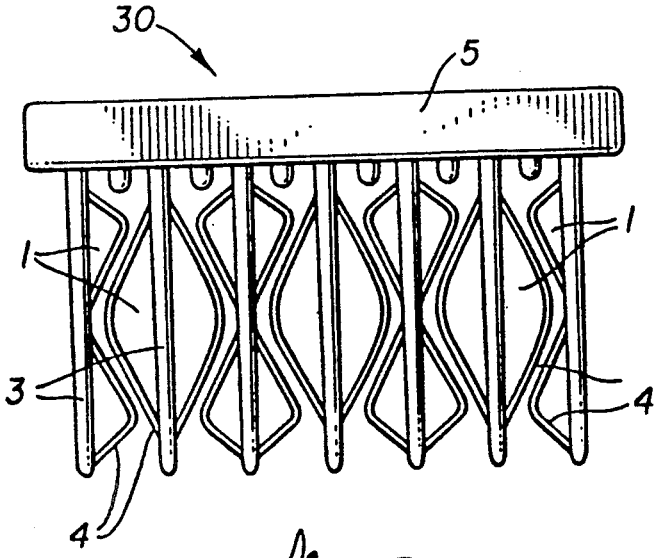
FIG. 3 is a front view of a first curve-backed hair comb embodying the present invention.

FIG. 3 shows a curve-backed comb 30 in accordance with the present invention, having a straight back 5 rather than the curved back 20 of the comb shown in FIG. 1. However, the principle of operation of the straight backed comb 30 is the same as the curved-back comb 10 in FIG. 1.

Figure 4:
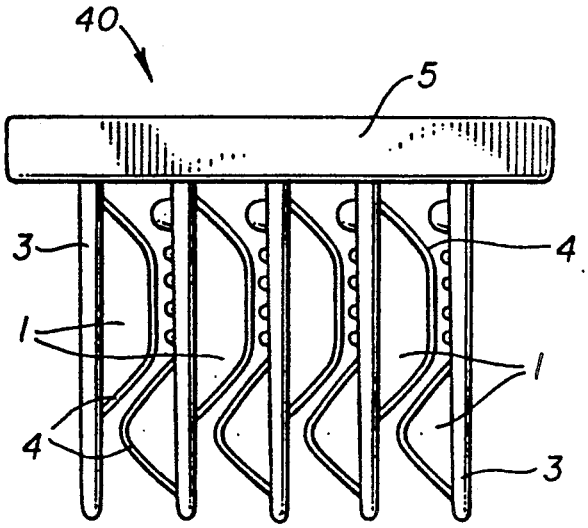
FIG. 4 is a front view of a second curve-backed hair comb embodying the present invention.

FIG. 4 shows an alternative embodiment of a curve-backed comb 40 having a slightly different configuration for the leaf-springs 4.

Figure 5:
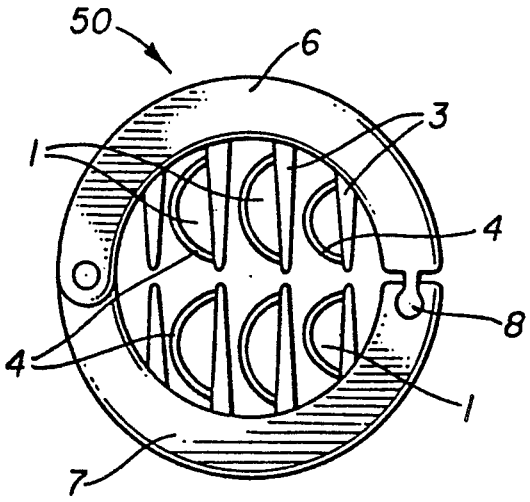
FIG. 5 is a front view of a circular hair fastening device embodying the present invention.

FIG. 5 shows a circular hair pin 50 made in accordance with the present invention. The pin 50 comprises two pivoting semi-circular halves 6, 7 each having a set of teeth 3 and associated leaf springs 4. A clasp or locking mechanism 8 is provided such that the two semi-circular halves 6, 7 can be locked together after insertion of the device into a user's hair. The circular hair pin 50 operates in the same fashion as the embodiments discussed above, except that both of the semi-circular halves 6, 7 are inserted into the hair (for example, when used with a "pony tail").

Figure 6:
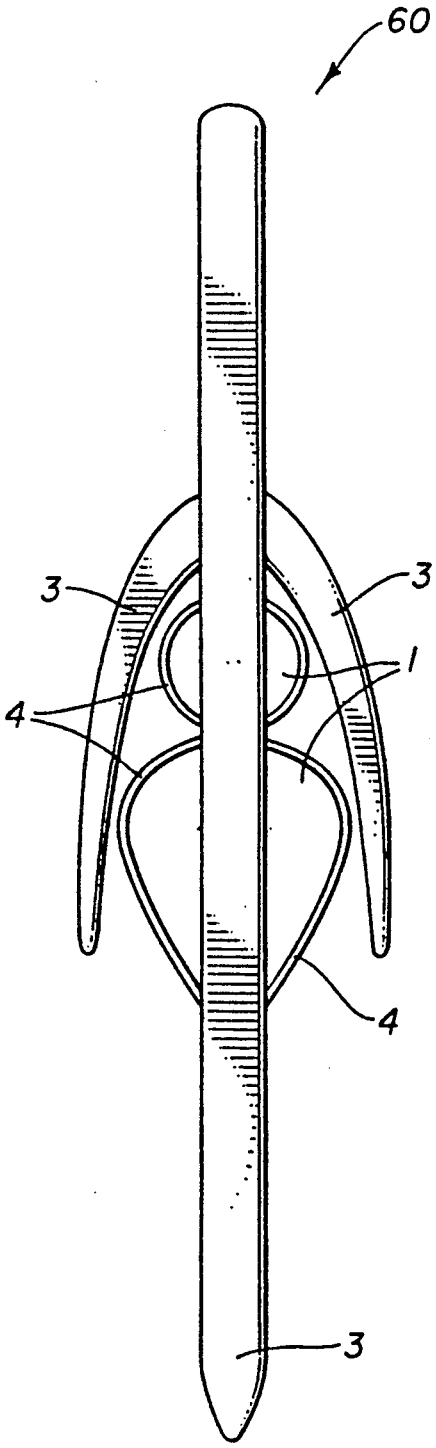
FIG. 6 is a front view of a chignon pin embodying the present invention.

FIG. 6 shows a chignon pin 60 having teeth 3 and leaf-springs 4 made in accordance with the present invention. The teeth 3 of the chignon pin 60 may also be referred to as tines or prongs. Between at least some of the teeth 3 are leaf-springs 4 that function in the same manner as the leaf-springs 4 shown in the devices of FIGS. 1–5.

The illustrated embodiments show the leaf-springs 4 as being connected to a tooth 3 at both ends of each spring 4. However, the leaf-springs 4 can be made such that they are not connected at one end to a tooth 3. In some uses, this may have the drawback of catching hair either upon insertion or withdrawal of a hair fastening device. In other uses, such a characteristic may be desirable.

Although the illustrated embodiments show leaf-springs 4 between each pair of teeth 3, it is not necessary that every pair of teeth 3 have leaf-springs 4 situated therebetween. Further, the leaf-springs 4 may be formed attached to only one of a pair of teeth 3, as shown in FIGS. 5 and 6. In this configuration, the restorative spring force of the single leaf-spring 4 exerts a clamping force against the hair, pressing the hair against the adjacent opposing tooth 3.

A number of embodiments of the present invention have been described. Nevertheless, it will be understood that various modifications may be made without departing from the spirit and scope of the invention. For example, the spacing between adjacent paired leaf-springs 4, or between a single leaf spring 4 and an adjacent opposing tooth 3, can be varied as desired during manufacture to alter the clamping force exerted by the leaf-springs 4. The thickness of the leaf-springs 4 can also be varied during manufacture to alter the clamping force. Accordingly, it is to be understood that the invention is not to be limited by a specific illustrated embodiments, but only by the scope of the appended claims.

I claim:

1. A hair fastening device including:

a. a support structure;

b. a plurality of spaced-apart teeth, fastened to the support structure, for separating strands of hair; and c. a plurality of leaf springs, each attached to a respective tooth and positioned between such tooth and an adjacent tooth, for clasping hair passing between such tooth and the adjacent tooth, wherein, in at least one space between two adjacent teeth, two of said springs are each attached to a respective tooth to face one another, and at least one of said two springs has greater flexibility than said teeth.

2. The hair fastening device of claim 1, wherein at least one leaf spring is positioned between each pair of teeth.

3. The hair fastening device of claim 1, wherein at least two leaf springs are positioned between each pair of teeth.

4. The hair fastening device of claim 1, wherein the support structure is straight.

5. The hair fastening device of claim 1, wherein the support structure is curved.

6. The hair fastening device of claim 1, wherein the hair fastening device is a comb.

7. The hair fastening device of claim 1, wherein the hair fastening device is a chignon pin.

8. The hair fastening device of claim 1, wherein each leaf spring is integrally formed as part of a tooth.

9. The hair fastening device of claim 1 wherein there is a spacing between said two springs which are positioned between two adjacent teeth.

10. The hair fastening device of claim 9 wherein said structure, said teeth and said springs are formed as an integrally molded structure.

11. The hair fastening device of claim 10 wherein: each said spring has two ends via which said spring is attached to a respective tooth so that an open space exists between said spring and said respective tooth; and two of said springs are located in each space between two adjacent teeth.

12. The hair fastening device of claim 11 wherein said structure, said teeth and said springs are formed as an integrally molded structure.

13. A hair fastening device including:

a support structure;

at least three spaced-apart teeth, fastened to the support structure, for separating strands of hair and;

a plurality of leaf springs, each attached to a respective tooth and positioned between such tooth and an adjacent tooth, for clasping hair passing between such tooth and the adjacent tooth, wherein, in each space between two adjacent teeth, two of said springs are each attached to a respective tooth to face one another, at least one of said two springs has greater flexibility than said teeth.

14. The hair fastening device of claim 13 wherein each said spring has two ends via which said spring is attached to a respective tooth.

15. The hair fastening device of claim 14 wherein each spring is attached to a respective tooth such that an open space exists between said spring and said respective tooth.

16. The hair fastening device of claim 13 wherein said springs in each space between two adjacent teeth at least approximately conform in shape to one another.

17. The hair fastening device of claim 13 wherein there is a spacing between two springs which are positioned between each pair of teeth.

18. The hair fastening device of claim 13 wherein said structure, said teeth and said springs are formed as an integrally molded structure.

* * * * *